United States Patent [19]

Delair et al.

[11] Patent Number: 4,876,705

[45] Date of Patent: Oct. 24, 1989

[54] X-RAY TUBE WITH A MOLYBDENUM TARGET

[75] Inventors: Jacques Delair, Bois D'Arcy; Olivier Peyret, Boulogne Billancourt, both of France

[73] Assignee: General Electric CGR S.A., Paris, France

[21] Appl. No.: 269,719

[22] Filed: Nov. 10, 1988

[30] Foreign Application Priority Data

Nov. 13, 1987 [FR] France ..... 87 15671

[51] Int. Cl.[4] ..... H01J 35/10

[52] U.S. Cl. ..... 378/144; 378/143

[58] Field of Search ..... 378/143, 144

[56] References Cited

U.S. PATENT DOCUMENTS 3,869,635 3/1975 Friedel ..... 378/144
4,131,718 12/1978 Childeric ..... 378/144
4,271,372 6/1981 Geldner et al. ..... 378/144
4,641,334 2/1987 Devine, Jr. .

FOREIGN PATENT DOCUMENTS 2349953 11/1977 France .
2500958 9/1982 France .

OTHER PUBLICATIONS

Patent Abstracts of Japan, vol. 10, No. 117 (E-400)[2174] May 2, 1986 & JP-A-60250546 12/11/85, Rotor for X-Ray Tube Hideo, Nakae.

*Primary Examiner*—Craig E. Church
*Attorney, Agent, or Firm*—Oblon, Spivak, McClelland, Maier & Neustadt

[57] ABSTRACT

An X-ray tube, the anode of which has a molybdenum target, is disclosed. In odrer to prevent cracks from forming in the target under the effect of electron bombardment, the molybedenum is alloyed with vanadium.

7 Claims, 1 Drawing Sheet

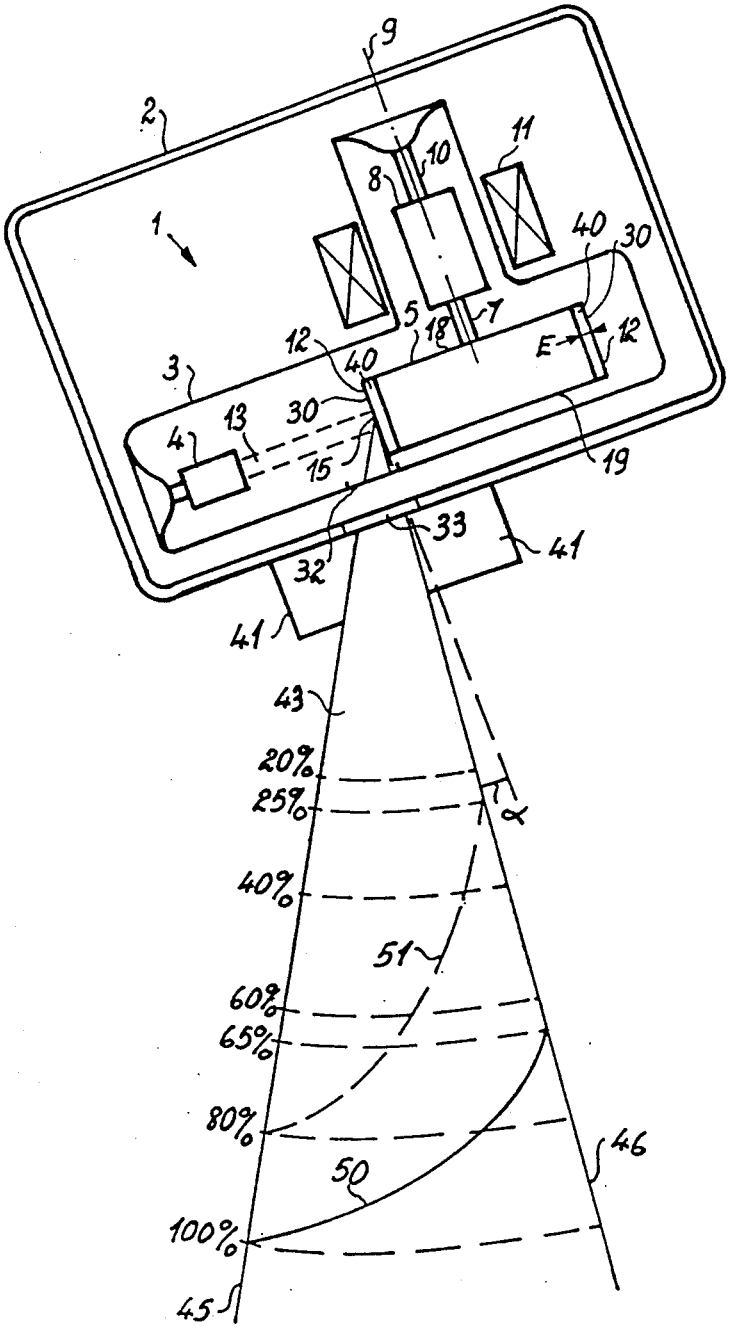
9
2
11
10
8
1
40
30
5
18
7
12
E
12
3
12
40
30
13
4
15
19
33
41
32
41
43
20%
25%
α
40%
51
60%
65%
80%
46
50
100%
45

X-RAY TUBE WITH A MOLYBDENUM TARGET

BACKGROUND OF THE INVENTION

1. Field of the Invention

The invention concerns an X-ray tube, especially for X-ray examination of the breast and, in particular, it concerns an anode target made of molybdenum.

With an X-ray tube, the X-radiation is obtained under the effect of an electronic bombardment of a target borne by the anode or formed by the anode itself. On the target, a small surface is subjected to electron bombardment and forms the source of X-radiation. The characteristics of the X-radiation depend on the characteristics on the incident electron beams and the nature of the material forming the target.

Molybdenum targets are commonly used in the anodes of X-ray tubes designed for X-ray examination of the breast.

The usefulness of a molybdenum target, in X-ray examinations of the breast, lies especially in the fact that the energy spectrum of the X-radiation emitted by molybdenum is particularly suited to the specific nature of such examinations. For, the breast has low X-ray absorption characteristics, and the anomalies sought have density levels which are very close to those of surrounding tissues. The contrast presented, between these anomalies and the surrounding tissue, in an X-ray picture is considerably improved when the X-radiation used has a narrow energy band containing the characteristic lines displayed by molybdenum.

Molybdenum targets are commonly obtained by sintering molybdenum powder. Most often, it is the anode itself that is made by sintering molybdenum powder, the target being formed by a part of the anode. The anode may be of the fixed anode or rotating anode type. Other standard methods such as, for example, vapor phase chemical deposition or, again, electrolytic deposition enable the depositing of a layer of molybdenum on the anode in order to form a target on the entire surface of the anode or on a part of this surface, along a focal track for example, in the case of a rotating anode.

The repeated electron bombardments to which the molybdenum target is subjected create thermomechanical strains in this target, causing the molybdenum to form cracks. The cracks increase in number and size with the number of exposures. These cracks reduce the X-ray transmission efficiency of the X-ray tube. This can be explained by the fact that electrons which fall in the cracks create X-radiation, a large proportion of which is absorbed in the anode itself.

The fall in X-ray efficiency leads, particularly, to the following two drawbacks which are particularly important in the case of X-ray examinations of the breast.

1° A deterioration in the quality of the image which can be explained, firstly, by an increase in kinetic fuzziness or movement fuzziness, which is due to the increase in exposure time made necessary by the fall in X-ray efficiency and, secondly, by the non-homogeneity in the density of the picture, due to an accentuation of a phenomenon of variations in X-ray efficiency in the field.

2° An increase in the dose received by the patient, owing to deviation from the so-called relationship of reciprocity between the film/screen pair used in X-ray examinations of the breast: for, the non-reciprocity of the receiver (film/screen) makes the quantity of photons needed to achieve maximum density of the film increase when the exposure time increases.

Thus, for example, in a direction neighbouring that where the X-radiation is at its maximum, this intensity is reduced by about 20% after three months of normal operation of the X-ray tube, and it is reduced by about 40% in a plane neighbouring the anode plane.

The present invention concerns an X-ray tube with a fixed or rotating anode which is particularly, but not exclusively, designed for X-ray examination of the breast, said anode having a molybdenum target which does not have the above-mentioned problems of cracking or, if at all, then at the end of a far longer operating time and to a much smaller degree than with a prior art molybdenum target This is obtained by doping of the molybdenum. We feel that this doping has the effect of reinforcing the grain association and the molybdenum grains themselves, and of making the molybdenum more elastic.

SUMMARY OF THE INVENTION

According to the invention, there is proposed an X-ray tube comprising an anode and a cathode, with the cathode delivering an electron beam and the anode comprising a target bombarded by the electron beam on a surface forming the source of X-radiation, said target being made of molybdenum, wherein the molybdenum is alloyed with vanadium.

We have further noted that the doping of the molybdenum with vanadium has a major advantage in the case of an X-ray tube used in X-ray examinations of the breast. This advantage lies in the fact that the characteristic lines of vanadium, emitted under electron bombardment, are totally removed by standard filtration of the X-radiation emitted by the X-ray tube, so that the X-ray spectrum is not modified by the presence of vanadium.

BRIEF DESCRIPTION OF THE DRAWING

The invention will be better understood from the following description, given as a non-exhaustive example, and from the single appended figure which gives a schematic view of an X-ray tube according to the invention.

DESCRIPTION OF A PREFERRED EMBODIMENT

The figure shows a non-restrictive exemplary view of an X-ray tube 1 according to the invention, especially designed for mamography. The X-ray tube 1 is contained in a standard way in a casing 2. The X-ray tube 1 has an enclosing envelope 3, made of glass for example, containing a cathode 4 and an anode 5. In the non-restrictive example described, the anode 5 is a rotating anode with the general shape of a disk, placed at the center of the disk by a supporting shaft 7, which is solidly joined to a rotor 8. The rotor 8 is placed in an axis of symmetry 9 of the anode disk 5. The rotor 8 is itself carried in a standard way by a support 10 fixed to the envelope 3. A stator 11 is placed outside the envelope 3 and causes the rotation of the rotor 8 and, consequently, the rotation of the anode 5 on its axis of symmetry 9. The cathode 4 is also carried in a standard way by the envelope 3 facing the rim 12 of the anode disk 5.

The cathode 4 delivers an electron beam 13 which impinges upon a target 33 which, in the non-exhaustive example described, is formed on the edge 12. Since the anode 5 is a rotating anode, the target 30 forms a focal track along the edge 12 and around the axis of symmetry 9. The electron beam 13 impinges upon the target 30 on a limited area 15 of this target, called a focus, forming the source of X-radiation.

According to a feature of the invention, the target 30, impinged by the electron beam 13, is made up of molybdenum alloyed with vanadium or doped with vanadium in a proportion of at least 0.5% by weight. This makes it possible to substantially delay the aging of the target 30 and to substantially reduce its cracking under the effect of impingement by the electron beam 13 as mentioned earlier. A great improvement is observed from a value of 0.5% by weight of vanadium onwards, the optimum condition being one where the vanadium is mixed with molybdenum in a proportion, by weight, ranging between 2.5% and 3.5%. An excess of vanadium, from 7% onwards for example, may lead to a considerable reduction in the X-radiation intensity after filtering, if a filtration of the X-radiation leaving the tube 1 is done to obtain a situation where the energy spectrum of the X-radiation covers a relatively narrow band containing the characteristic lines of molybdenum.

In the non-exhaustive example described, this filtering is achieved at an output window 33 through which the X-radiation leaves the casing 2 after coming out of the tube 1 through a first outlet window 32 which absorbs little X-radiation. The first outlet window 32 is made, for example, in a standard way of beryllium and the second window 33 is made of molybdenum.

The target 12 may be made in different ways:

the target 30 may be formed, for example, directly by the anode 5 itself, which is then made of molybdenum doped with vanadium in the proportions specified above; the anode 5 may be made, in this case, for example, by the sintering method (according to a method known per se) of molybdenum powder with which the vanadium is mixed;

but the target 30 may be made in the form of a layer 40 of the molybdenum-vanadium mixture, said layer 40 being deposited at the desired location on the anode disk 5 which, in this case, forms a basic body formed, for example, of molybdenum. The layer 40 of molybdenum/vanadium may be deposited with a thickness E of a few micrometers. The deposition may be done, for example, by means of a method which is standard per se such as, for example, an electrolytic deposition method or a vapor phase chemical deposition method in which there is made a mixture of gaseous compounds of molybdenum and vanadium in proportions such that, given the kinetic nature of the reactions and the experimental conditions (temperature, pressure, gas introduction speed, etc.), the desired proportions of the deposit are achieved.

The X-radiation leaving the casing 2 goes, in a standard way, through a collimator 41 and then forms a useful X-radiation 43 with limits 45, 46. The first limit 45, located on the cathode 4 side, represents the limit of the X-ray beam 43 which, in X-ray examinations of the breast, is generally located towards the rib cage of the patient (not shown) whereas, on the anode 5 side, the second limit 46 represents the limit of the beam located towards the tip or nipple of a breast to be examined. The second limit 46 forms, with the anode plane formed by the edge 12, an angle $\alpha$ which is relatively small, for example 2°, and the drop in efficiency mentioned above is a characteristic of the X-radiation 43 between the two limits 45, 46. This means that the intensity of the X-radiation increases from the second limit 46 to the first limit 45 in a way which tends to compensate for variations in the absorption of X-radiation by the breast (not shown) due to variations in the thickness of said breast between the nipple and the rib cage.

A curve 50 illustrates, as a non-exhaustive example, the variation in intensity of the radiation between the two limits 45, 46. The curve 50 expresses these variations in terms of percentage of a maximum intensity of the X-radiation along the first limit 45. In following the curve 50, it is observed that the intensity of the X-radiation, which is 100% at the first limit 45, is decreased with an increasingly accentuated slope until about 65% at the second limit 46.

This corresponds to a case where the target is practically not cracked, either because this target consists of molybdenum doped with vanadium according to the invention or because this target is made of pure molybdenum which has been subjected to very little electron impingement.

A second curve 51, in dashes, illustrates the modifications undergone by the X-radiation intensity under the same conditions as in the above example, but for a prior art molybdenum target for which the aging, under the effect of electron impingements, has led to its cracking. It is observed that the intensity of the X-radiation at the first limit 45 is about 80%, i.e. that it is reduced by about 20%, and the second curve 51 shows that the intensity of the X-radiation is reduced with a far more accentuated slope than in the first case and reaches 25% at the second limit 46.

This shows that a target 30 made of molybdenum, alloyed or doped with vanadium according to the invention, makes it possible, by preventing cracks in the target due to repeated electron impingement, to prevent a major reduction in the intensity of the X-radiation and in its development in the field, these two drawbacks being particularly serious for an X-ray tube used in X-ray examinations of the breast.

What is claimed is:

1. An X-ray tube comprising an anode and a cathode, with the cathode delivering an electron beam and the anode comprising a target impinged by the electron beam on a surface forming the source of an X-radiation, said target being made of molybdenum, wherein the molybdenum is alloyed with vanadium in a proportion, by weight, of at least 0.5%.

2. An X-ray tube according to claim 1, wherein the vanadium is alloyed with molybdenum in a proportion, by weight, of 2.5 to 3.5%.

3. An X-ray tube according to claim 1 or 2, wherein the target is formed directly by the anode, said anode being made by the sintering of a molybdenum powder with which vanadium is mixed.

4. An X-ray tube according to claim 1 or 2, wherein the anode comprises a basic body on which the target is deposited in the form of a layer.

5. An X-ray tube according to claim 4, wherein the deposition of the layer forming the target is achieved by a vapor phase chemical deposition method.

6. An X-ray tube according to claim 5, wherein the anode is a rotating anode.

7. An X-ray tube according to claim 6, said tube constituting the X-ray tube of an apparatus for X-ray examinations of the breast.

* * * * *